US010822976B2

(12) United States Patent
Davis, III et al.

(10) Patent No.: US 10,822,976 B2
(45) Date of Patent: Nov. 3, 2020

(54) NOZZLE INSERT RIB CAP

(71) Applicant: General Electric Company, Schenectady, NY (US)

(72) Inventors: Charles Lewis Davis, III, Simpsonville, SC (US); Frederick James Brunner, Greenville, SC (US)

(73) Assignee: General Electric Company, Schenectady, NY (US)

( * ) Notice: Subject to any disclaimer, the term of this patent is extended or adjusted under 35 U.S.C. 154(b) by 768 days.

(21) Appl. No.: 15/203,098

(22) Filed: Jul. 6, 2016

(65) Prior Publication Data

US 2016/0312630 A1 Oct. 27, 2016

Related U.S. Application Data

(63) Continuation-in-part of application No. 13/908,039, filed on Jun. 3, 2013, now abandoned.

(51) Int. Cl.
*F01D 9/06* (2006.01)
*F01D 5/18* (2006.01)

(52) U.S. Cl.
CPC ..... *F01D 9/065* (2013.01); *F01D 5/189* (2013.01); *Y10T 29/49323* (2015.01)

(58) Field of Classification Search
CPC ..... F01D 9/065; F01D 5/188; F01D 5/189; Y10T 29/49323
See application file for complete search history.

(56) References Cited

U.S. PATENT DOCUMENTS

| | | | |
|---|---|---|---|
| 5,145,315 | A | 9/1992 | North et al. |
| 6,120,244 | A | 9/2000 | Fukura |
| 6,428,273 | B1 | 8/2002 | Keith et al. |
| 6,453,557 | B1 | 9/2002 | Burdgick |
| 6,461,109 | B1 | 10/2002 | Wedlake et al. |
| 6,503,054 | B1 | 1/2003 | Bielek et al. |
| 6,773,229 | B1 | 8/2004 | Itzel et al. |
| 7,121,796 | B2 | 10/2006 | Burdgick et al. |
| 7,465,152 | B2 | 12/2008 | Nigmatulin |
| 7,798,773 | B2 | 9/2010 | Pellet et al. |
| 7,819,628 | B2 | 10/2010 | Dervaux et al. |
| 8,052,378 | B2 | 11/2011 | Draper |
| 8,210,544 | B2 | 7/2012 | Waddell et al. |

(Continued)

FOREIGN PATENT DOCUMENTS

JP 07217404 A * 8/1995

*Primary Examiner* — Igor Kershteyn
*Assistant Examiner* — Jesse M Prager
(74) *Attorney, Agent, or Firm* — Hoffman Warnick LLC

(57) ABSTRACT

A nozzle assembly includes a first nozzle cavity, a second nozzle cavity, a rib positioned between the nozzle cavities, a rib cap positioned on the rib, a first cavity insert, and a second cavity insert. The rib cap is wider than the rib, such that the rib cap extends outwardly into those portions of the nozzle cavities immediately adjacent the rib. The first cavity insert and the second cavity insert include a longitudinal surface offset from the rib. The offset surfaces include rib cap-interface surfaces that are joined to the rib cap. A method of modifying the nozzle assembly is achieved by installing a rib cap having a width greater than that of the rib and by installing modified cavity inserts having a surface offset from the rib, and by joining rib cap-interface surfaces of the modified cavity inserts to the rib cap.

14 Claims, 10 Drawing Sheets

(56) References Cited

U.S. PATENT DOCUMENTS

| | | | | |
|---|---|---|---|---|
| 8,257,032 | B2 | 9/2012 | Beeck et al. | |
| 8,500,405 | B1 * | 8/2013 | Jones | F01D 9/065 415/115 |
| 2004/0170499 | A1 * | 9/2004 | Powis | F01D 5/189 416/97 R |
| 2007/0231150 | A1 * | 10/2007 | Dervaux | F01D 5/18 416/224 |
| 2009/0293495 | A1 | 12/2009 | Correia et al. | |

* cited by examiner

PRIOR ART

PRIOR ART

PRIOR ART

NOZZLE INSERT RIB CAP

CROSS-REFERENCE TO RELATED APPLICATIONS

The present application is a Continuation-In-Part of co-pending U.S. patent application Ser. No. 13/908,039, filed Jun. 3, 2013, entitled "Nozzle Insert Rib Cap," the entire disclosure of which is hereby incorporated by reference.

TECHNICAL FIELD

The present application relates generally to gas turbine engines and, more particularly, relates to a turbine nozzle with internal nozzle cavities separated by a rib, in which a rib cap is employed to ensure the installation of an appropriately sized and shaped cavity insert in each nozzle cavity.

BACKGROUND

Generally described, a heavy duty gas turbine includes alternating rows of stationary nozzles and rotating blades positioned along the hot gas path. Specifically, each turbine stage includes an array of circumferentially spaced, radially extending nozzle vanes. The nozzle vanes include vane airfoils that extend between inner and outer bands. The vane airfoils may be partially hollow and may form a part of a cooling circuit therein. Overall nozzle cooling schemes, however, may be somewhat complex given the three-dimensional aerodynamic profile of the vane airfoils and the varying heat loads therein.

The nozzle cooling schemes may use internal nozzle cavity inserts of varying configurations for use in different stages. The various nozzle cavity inserts may be functionally different but may be physically similar. During installation of the nozzle cavity inserts, attention must be paid to ensure the use of the correct cavity insert because the installation of the wrong insert could have a significant negative impact on overall nozzle cooling and performance. To reduce the likelihood of confusion during the installation, it may be desirable to provide the turbine airfoil with a rib cap, such that only complementary sized nozzle cavity inserts fit into the respective nozzle cavities.

Alternately, or in addition, at some point in the operating life of the turbine, it may be desirable to provide cavity inserts that are configured to improve the cooling of the turbine airfoils. Such an upgrade necessitates the removal of the previously installed cavity inserts and the installation of the improved cavity inserts. It would be desirable to provide additional modifications to the turbine airfoil (such as the installation of a rib cap) to ensure that the improved cavity inserts are not mistaken for the previously installed cavity inserts.

There is thus a desire for an improved turbine nozzle design. Such an improved nozzle design may prevent the installation of physically similar, but functionally different, nozzle cavity inserts in each nozzle cavity for improved overall cooling and performance.

SUMMARY

A nozzle assembly includes a first nozzle cavity, a second nozzle cavity, a rib positioned between the first nozzle cavity and the second nozzle cavity, a rib cap positioned on the rib, a first cavity insert, and a second cavity insert. The rib cap has a width greater than a width of the rib, such that the rib cap extends outwardly into portions of the first nozzle cavity and the second nozzle cavity immediately adjacent the rib. The first cavity insert and the second cavity insert include a longitudinal surface offset from the rib. The inlet edges of the offset surfaces of the first cavity insert and the second cavity insert contacting the rib cap are joined to the rib cap. A method of modifying the nozzle assembly is achieved by installing a rib cap wider than the rib, by installing modified cavity inserts having a surface offset from the rib, and by joining rib cap-interface surfaces of the modified cavity inserts to the rib cap.

According to a first embodiment, a nozzle assembly for use in a turbine engine includes a first nozzle cavity, a second nozzle cavity, and a rib separating the first nozzle cavity and the second nozzle cavity. The rib defines a longitudinal axis of the nozzle assembly and has an inlet surface on which a rib cap is installed. The rib cab, having a width greater than a width of the rib, extends outward from the rib into portions of the first nozzle cavity and the second nozzle cavity immediately adjacent the rib. A first cavity insert is installed in the first nozzle cavity, and a second cavity insert is installed in the second nozzle cavity. The first cavity insert and the second cavity insert each include a longitudinal surface offset from the rib, and inlet edges of the offset surfaces of the first cavity insert and the second cavity insert that contact the rib cap are joined to the rib cap.

According to another embodiment, a method of modifying a nozzle assembly includes providing a first nozzle with a first nozzle cavity insert installed in a first nozzle cavity and a second nozzle cavity insert in a second nozzle cavity. The first nozzle cavity and the second nozzle cavity are separated by a rib defining a longitudinal axis of the first nozzle. The method further includes removing the first nozzle cavity insert and the second nozzle cavity insert. A rib cap is installed onto an inlet surface of the rib, the rib cap having a width greater than a width of the rib, such that the rib cab extends outward from the rib into portions of the first nozzle cavity and the second nozzle cavity immediately adjacent the rib. A modified first cavity insert and a modified second cavity insert are provided, each of the modified first cavity insert and the modified second cavity insert including a longitudinal surface complementary to the rib. The modified first cavity insert is positioned into the first nozzle cavity, and the modified second nozzle cavity is positioned into the second nozzle cavity, such that the longitudinal surfaces are offset from the rib. The inlet edges of the longitudinal surfaces of the modified first cavity insert and the modified second cavity insert that contact the rib cap are joined to the rib cap.

These and other features and improvements of the present disclosure will become apparent to one of ordinary skill in the art upon review of the following detailed description when taken in conjunction with the several drawings and the appended claims.

DETAILED DESCRIPTION

Figure 1:
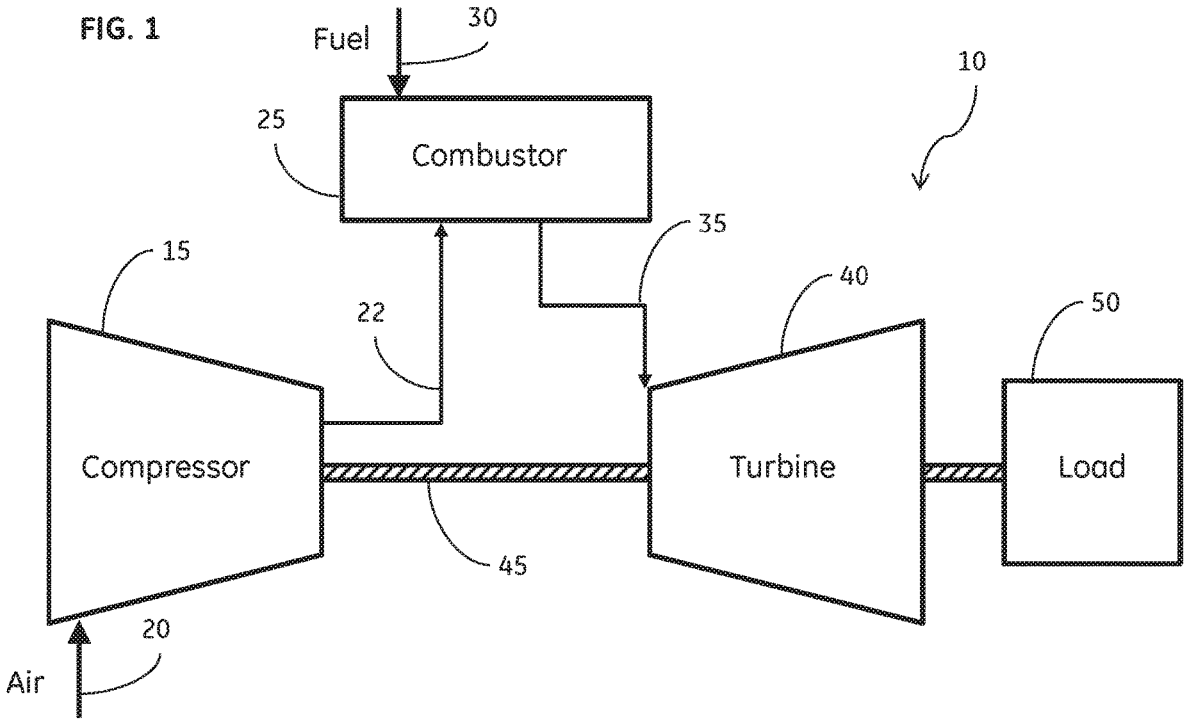
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers a flow of compressed air 22 to a combustor 25. The combustor 25 mixes the flow of compressed air 22 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50, such as an electrical generator and the like.

The gas turbine engine 10 may use natural gas, various types of liquid fuels, various types of syngas, and/or other types of fuels. The gas turbine engine 10 may be any one of a number of different gas turbine engines offered by General Electric Company of Schenectady, New York, including, but not limited to, 7-series or 9-series heavy duty gas turbine engines and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
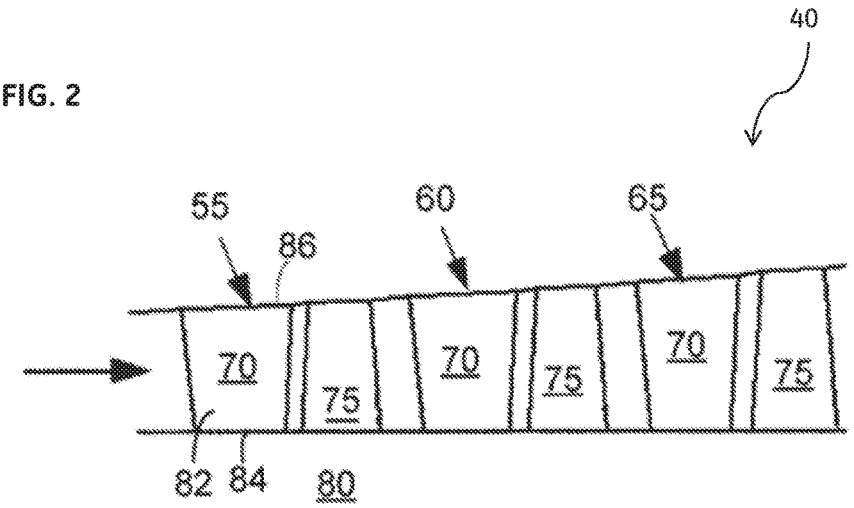
FIG. 2 is a schematic diagram of a portion of a turbine.

FIG. 2 shows is a schematic diagram of a portion of the turbine 40. By way of example only, the figure shows a first stage 55, a second stage 60, and a third stage 65 of the turbine 40. Any number of stages may be used herein. As described above, each stage may include a number of circumferentially spaced nozzles 70 and buckets 75. The buckets 75 are mounted on a turbine rotor 80 for rotation therewith. The nozzles 70 are circumferentially spaced from one another and fixed about an axis of the rotor 80. Each nozzle 70 may include a nozzle airfoil 82. The airfoils 82 extend from an inner band 84 to an outer band 86. Other components and other configurations may be used herein.

Figure 3:
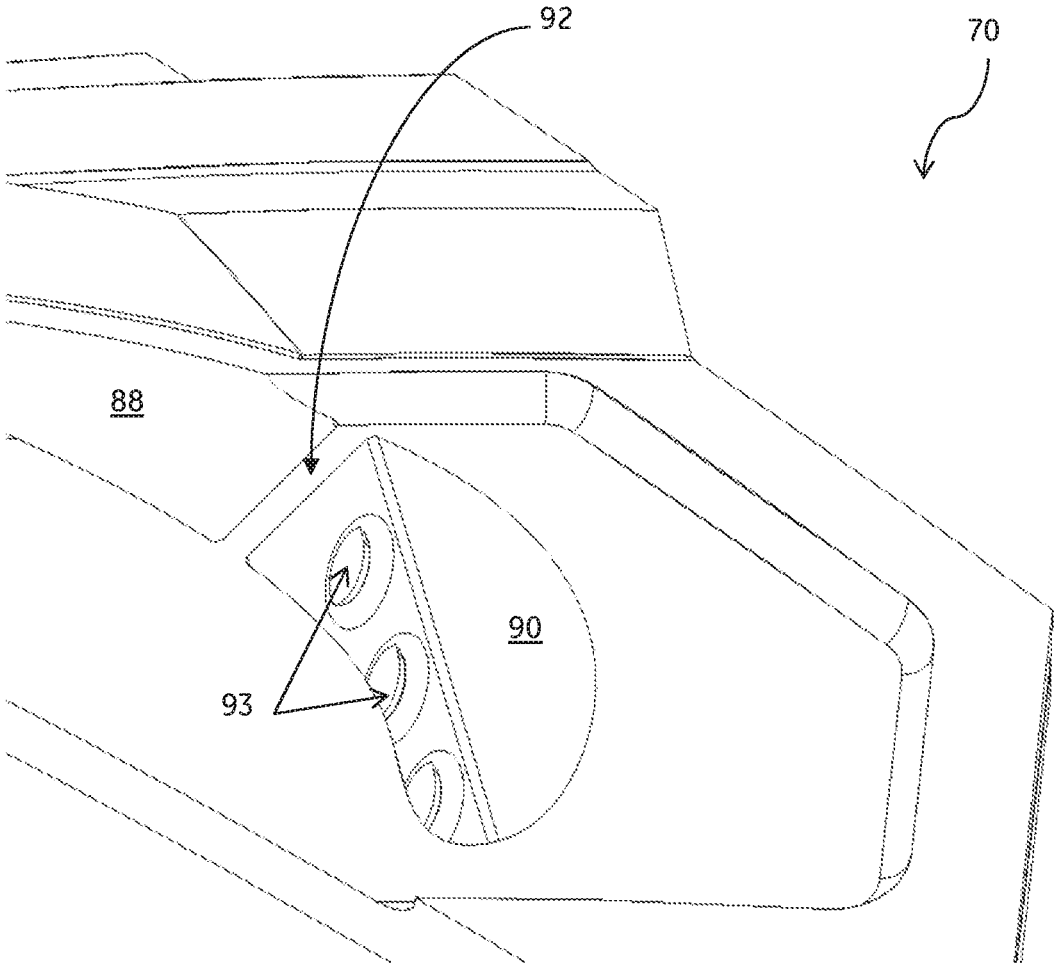
FIG. 3 is a perspective view of a portion of a conventional nozzle with a number of internal cavities and a rib.
Figure 4:
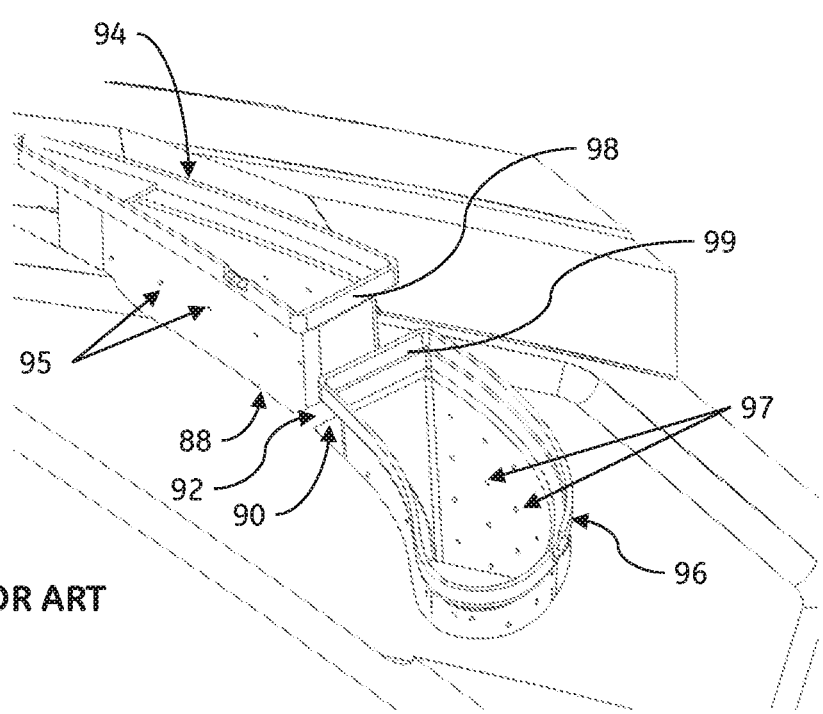
FIG. 4 is a perspective view of a nozzle, showing the partial installation of cavity inserts therein, according to the conventional approach.
Figure 5:
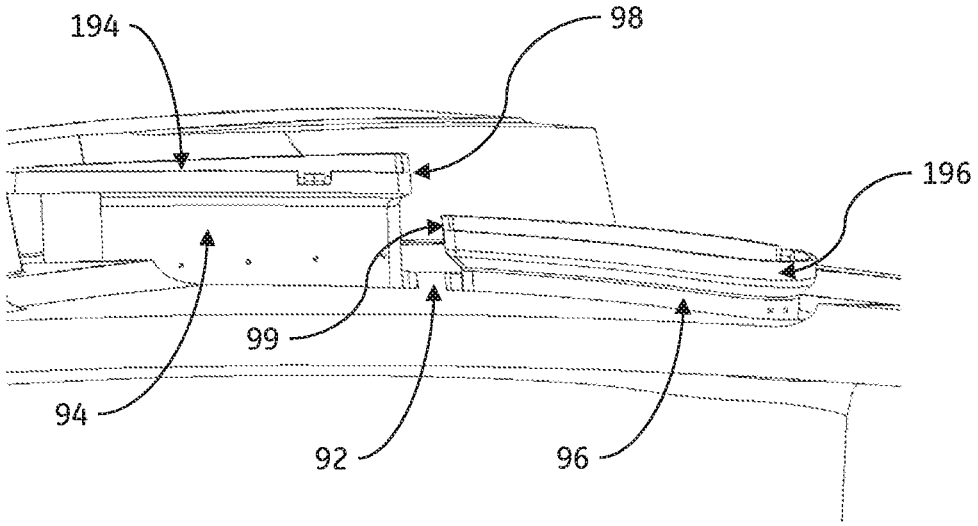
PRIOR ART FIG. 5
FIG. 5 is a side view of the nozzle and cavity inserts of FIG. 4.
Figure 6:
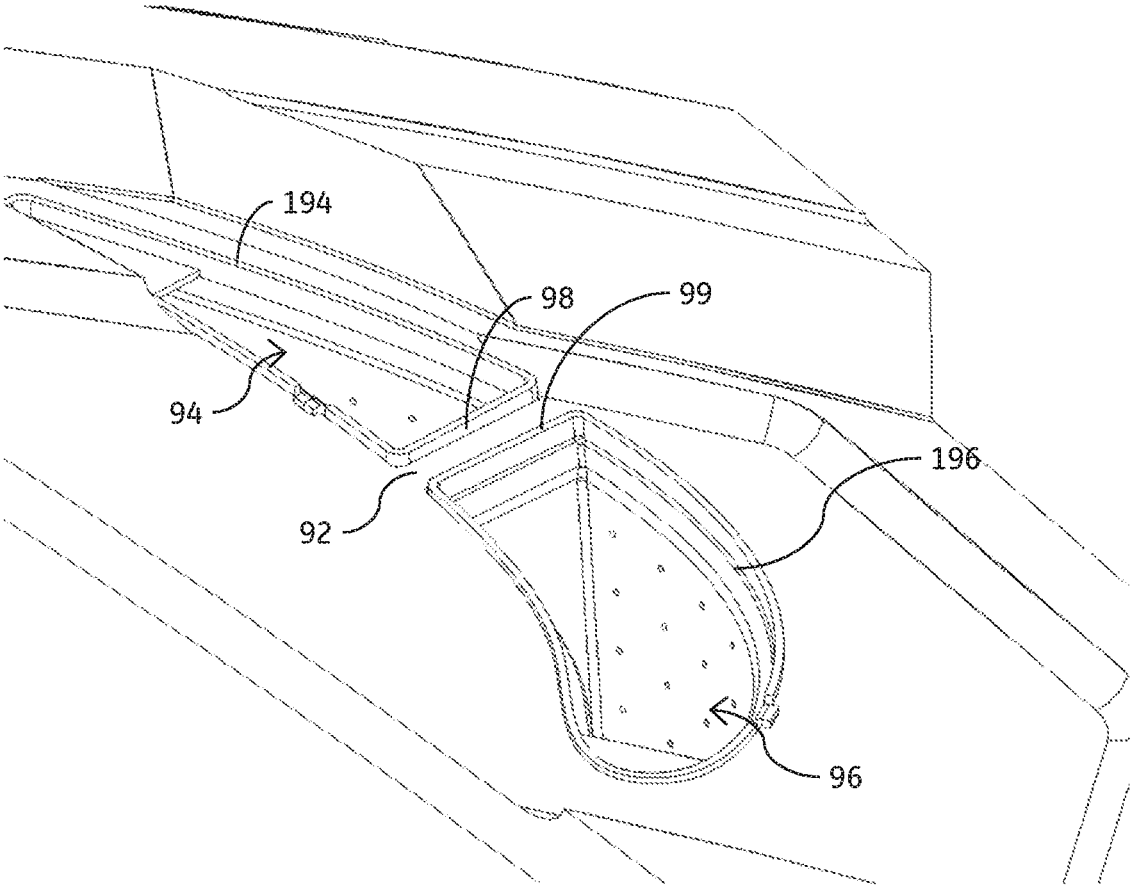
FIG. 6 is a partial perspective view of the nozzle of FIG. 3 with a number of cavity inserts positioned therein, as shown in FIGS. 4 and 5.

FIG. 3 shows an example of one of the nozzles 70. The nozzle 70 may include a number of cavities extending through the length of the airfoil 82. In this example, an aft cavity 88 and a forward cavity 90 are shown. The cavities 88, 90 may be defined by a longitudinal rib 92. In one embodiment, the rib 92 is provided with at least one air flow aperture 93 for permitting air flow between the aft cavity 88 and the forward cavity 90. In other embodiments, the rib 92 may not include at least one air flow aperture 93. The cavities 88, 90 and the ribs 92 may be of any size, shape, or configuration. The turbine 40 may have nozzles 70 with different cavity configurations (e.g., in each stage). As is shown in FIGS. 4 through 6, each of the cavities 88, 90 may be filled with an insert to promote cooling. In this example, an aft insert 94 and a forward insert 96 are shown. The inserts may have different configurations (e.g., cooling hole patterns) depending upon the axial location (stage) of the nozzle and the intended operating conditions of the turbine. Under normal circumstances, all of the forward inserts 96 of a particular stage are identical to one another, and all of the aft inserts 94 of a particular stage are identical to one another.

FIG. 4 shows the partial installation of the inserts 94, 96 in the respective nozzle cavities 88, 90. Each insert 94, 96 has a shape that is complementary to the nozzle cavity 88, 90, such that a small, uniform gap is defined between an outer surface of the insert 94, 96 and the inner surface of the nozzle cavity 88, 90. As shown in FIG. 4, the nozzle inserts 94, 96 are provided with a number of cooling holes 95, 97, respectively, for impingement cooling the inner surfaces of the airfoil 82 (that is, the cavities 88, 90).

As best seen in FIG. 5, the aft insert 94 is provided around its perimeter with an outwardly projecting (or flared) lip 194 that includes a rib-interfacing portion 98. The forward insert 96 is similarly provided around its perimeter with an outwardly projecting (or flared) lip 196 that includes a rib-interfacing portion 99. The rib-interfacing portions 98, 99 flare outward from a longitudinal axis of the nozzle 70 and extend radially beyond the inlet surface of the rib 92, when the inserts 94, 96 are fully installed (as shown in FIG. 6). Similarly, the perimeter of the outwardly projecting lips 194, 196 are positioned over the corresponding perimeter of the cavities 88, 90, forming a close relationship between the inserts 94, 96 and the cavities 88, 90. The inserts 94, 96 may be secured into the cavities 88, 90, around the outwardly projecting lips 194, 196, for example, by welding.

Figure 7:
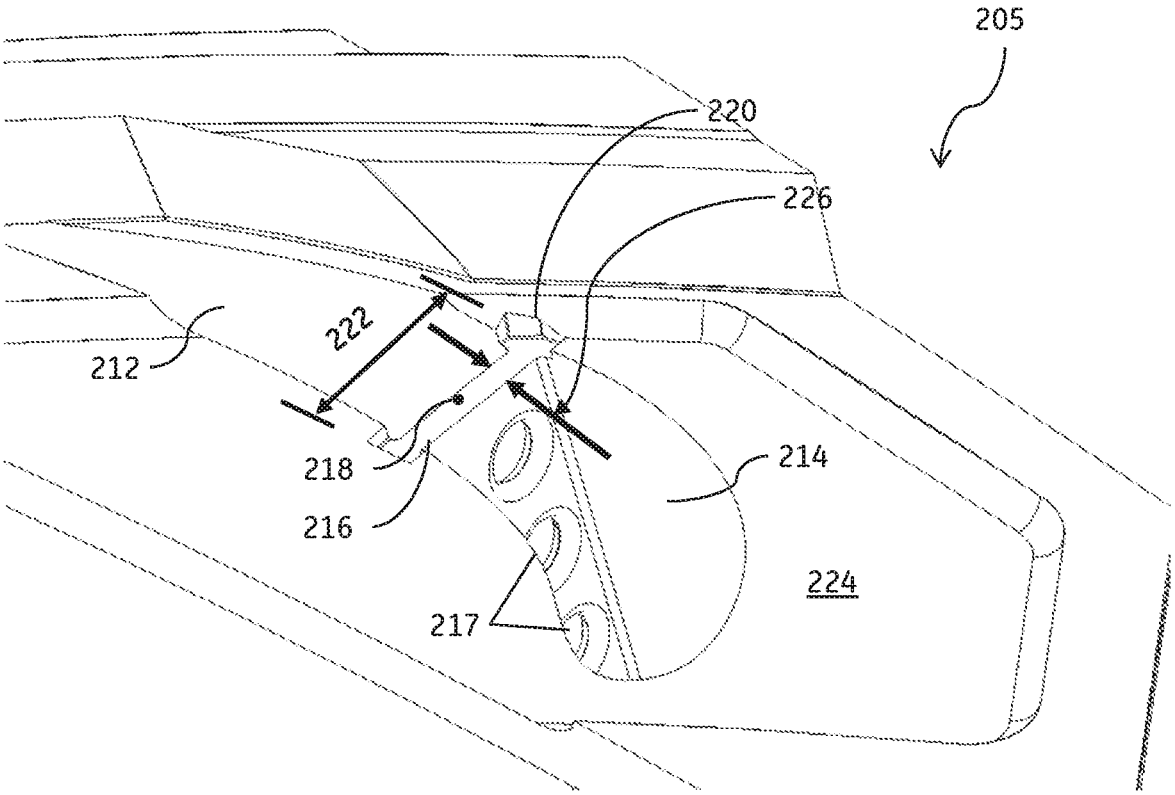
FIG. 7 is a perspective view of a portion of a nozzle with a number of internal cavities, a rib, and a rib cap recess, according to the present disclosure.
Figure 12:
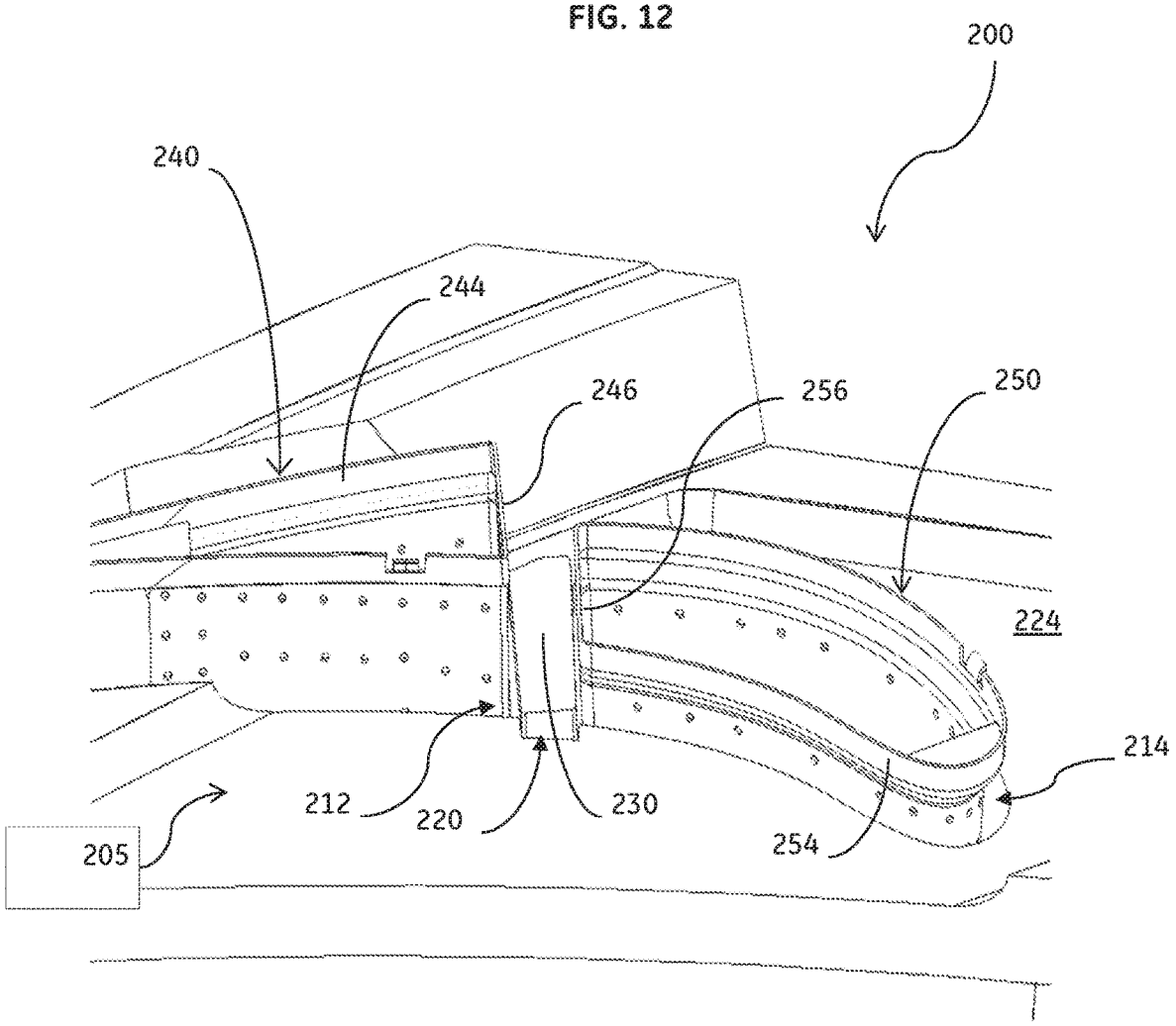
FIG. 12 is a perspective view of the nozzle assembly of FIG. 7, showing the partial installation of the cavity inserts of FIGS. 10 and 11 therein.
Figure 13:
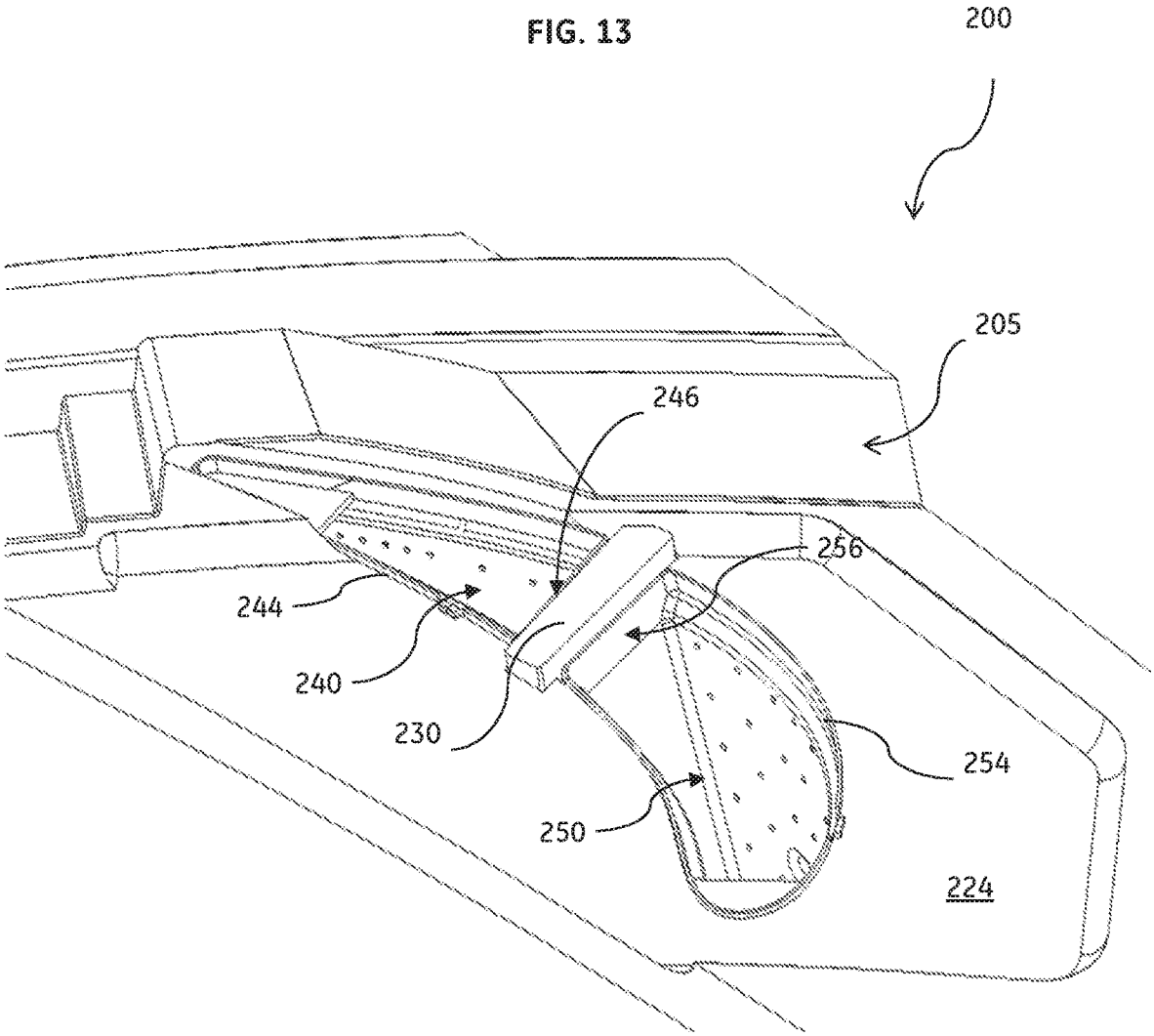
FIG. 13 is a perspective view of the nozzle assembly of FIG. 12, as may be described herein, with the nozzle having the present rib cap and the cavity inserts positioned therein.

FIG. 7 shows a portion of a nozzle 205, which may be part of a nozzle assembly 200 (as shown in FIGS. 12 and 13), according to the present disclosure. The nozzle 205 may be provided with a number of nozzle cavities 212, 214 therein. In this example, an aft cavity 212 and a forward cavity 214 are shown. Any number of the cavities 212, 214 may be used herein in any size, shape, or configuration, although, within a given turbine stage, the aft cavities 212 of the nozzles 205 are uniform with one another, and the forward cavities 214 are uniform with one another.

The cavities 212, 214 may be defined by a longitudinal rib 216. Any number of ribs 216 may be used herein in any size, shape, or configuration. In one embodiment, the rib 216 may be provided with at least one air flow aperture 217 for permitting fluid communication between the aft cavity 212 and the forward cavity 214. In other embodiments, the rib 216 may not be provided with at least one air flow aperture 217.

An inlet surface 218 of the rib 216 is machined to create a recessed area 220 slightly below a surrounding surface of a platform 224 of the nozzle 205. The machining may occur as part of an original assembly or may occur as part of an upgrade (replacement) of the original nozzle cavity inserts. The recess 220 may extend outward of the inlet surface 218 of the rib 216 into adjacent portions of the platform surface 224, as shown, to facilitate installation of a rib cap 230 (shown in FIG. 8). The recess 220 may be characterized as having a length 222 and a width 226.

Figure 8:
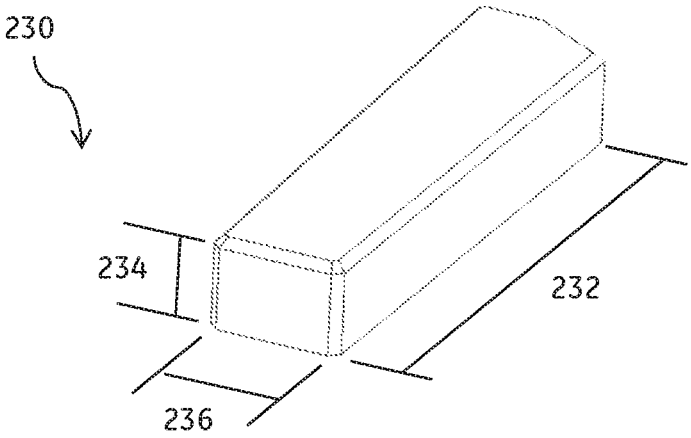
FIG. 8 is a perspective view of a rib cap, according to the present disclosure.
Figure 9:
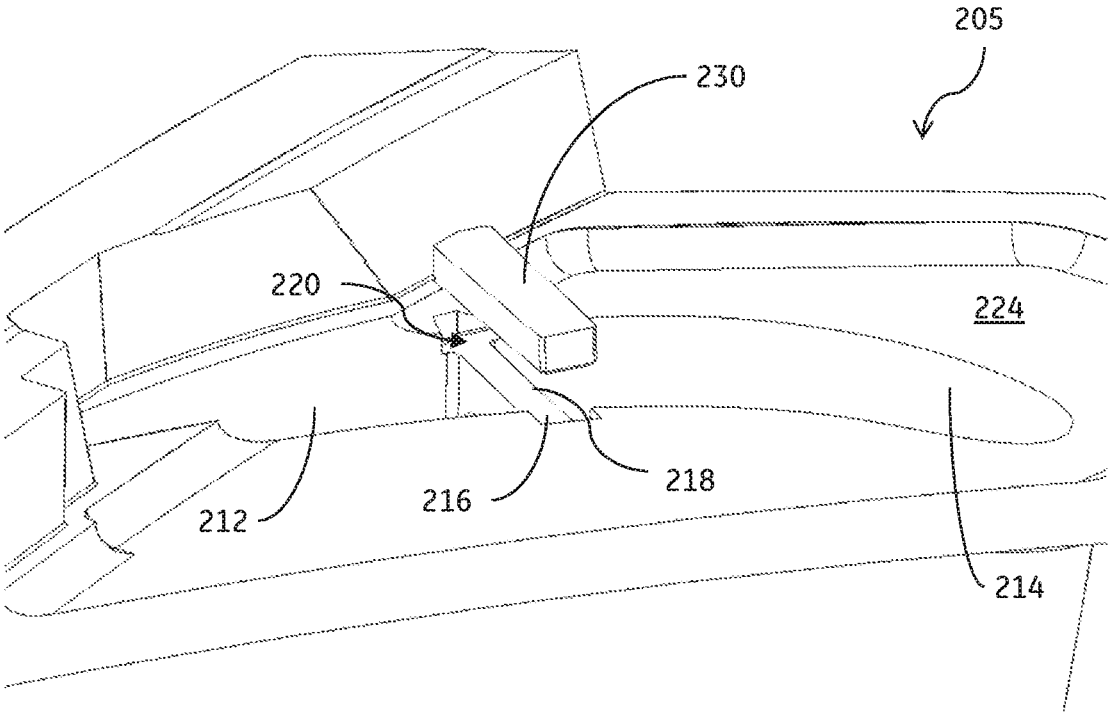
FIG. 9 is a perspective exploded view of the nozzle of FIG. 7, showing the rib cap and the rib cap recess.

FIG. 8 illustrates the rib cap 230, as having a generally rectangular shape. The rib cap 230 has a length 232, a height 234, and a width 236. The height 234 of the rib cap 230 is greater than the depth of the recess 220 (that is, the rib cap 230 projects outward of the nozzle platform 224). The width 236 of the rib cap 230 is greater than the width 226 of the inlet surface 218 of the rib 216, such that the rib cap 230 extends outward of the rib 216 into portions of the aft cavity 212 and the forward cavity 214 immediately adjacent the rib 216 (as shown in FIG. 9). The length 232 of the rib cap 230 corresponds to the length 222 of the recess 220. FIG. 9 illustrates the alignment of the rib cap 230 with the recess 220 along an inlet surface 218 of the rib 216 between the aft nozzle cavity 212 and the forward nozzle cavity 214. The rib cap 230 may be secured to the rib 216 by press fitting, brazing, welding, mechanical fastening, or a combination thereof. In the case of original make nozzles 205, the rib cap 230 may be cast as an extension of the rib 216.

Figure 10:
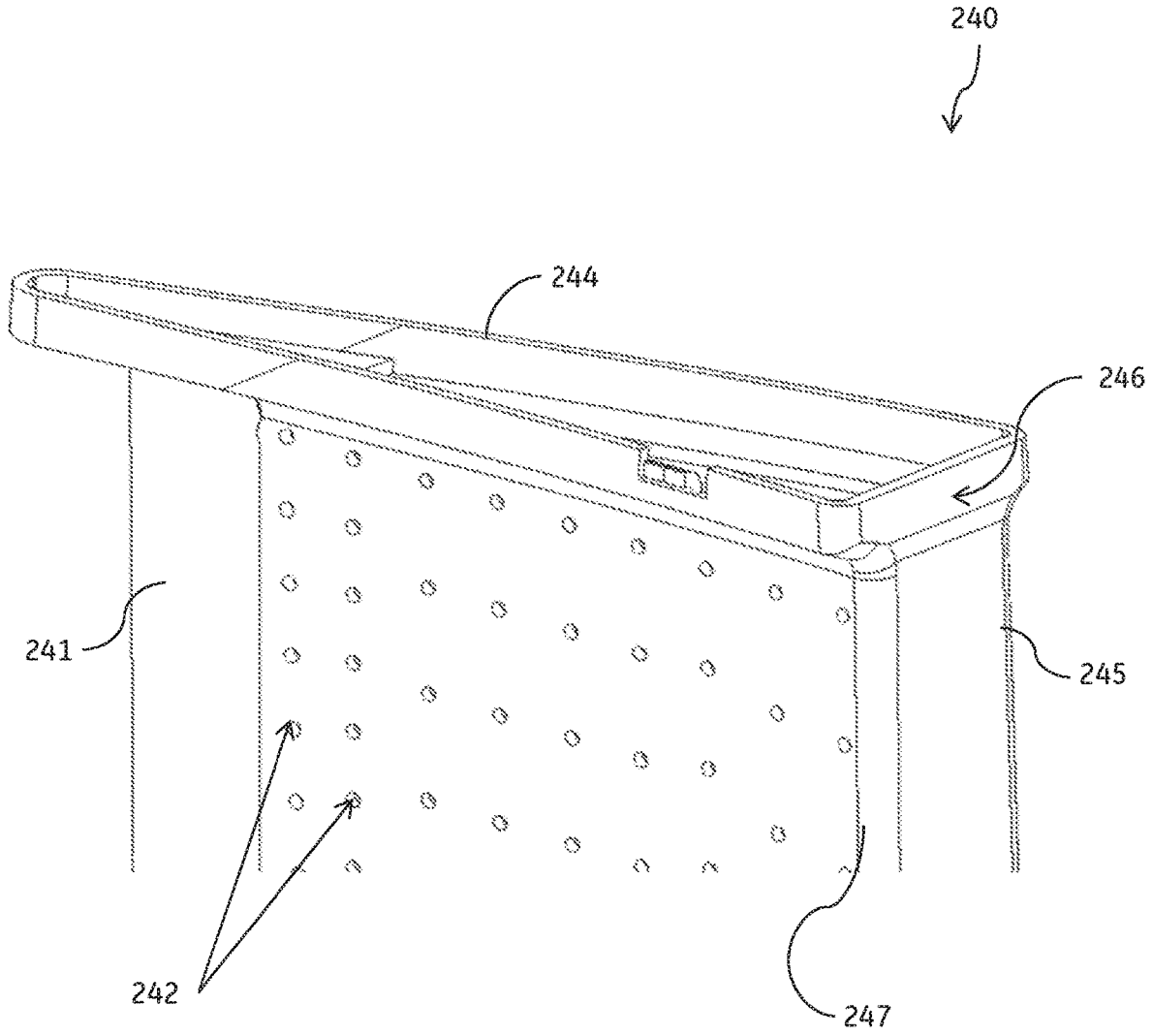
FIG. 10 is a perspective view of an exemplary aft cavity insert, according to the present disclosure.
Figure 11:
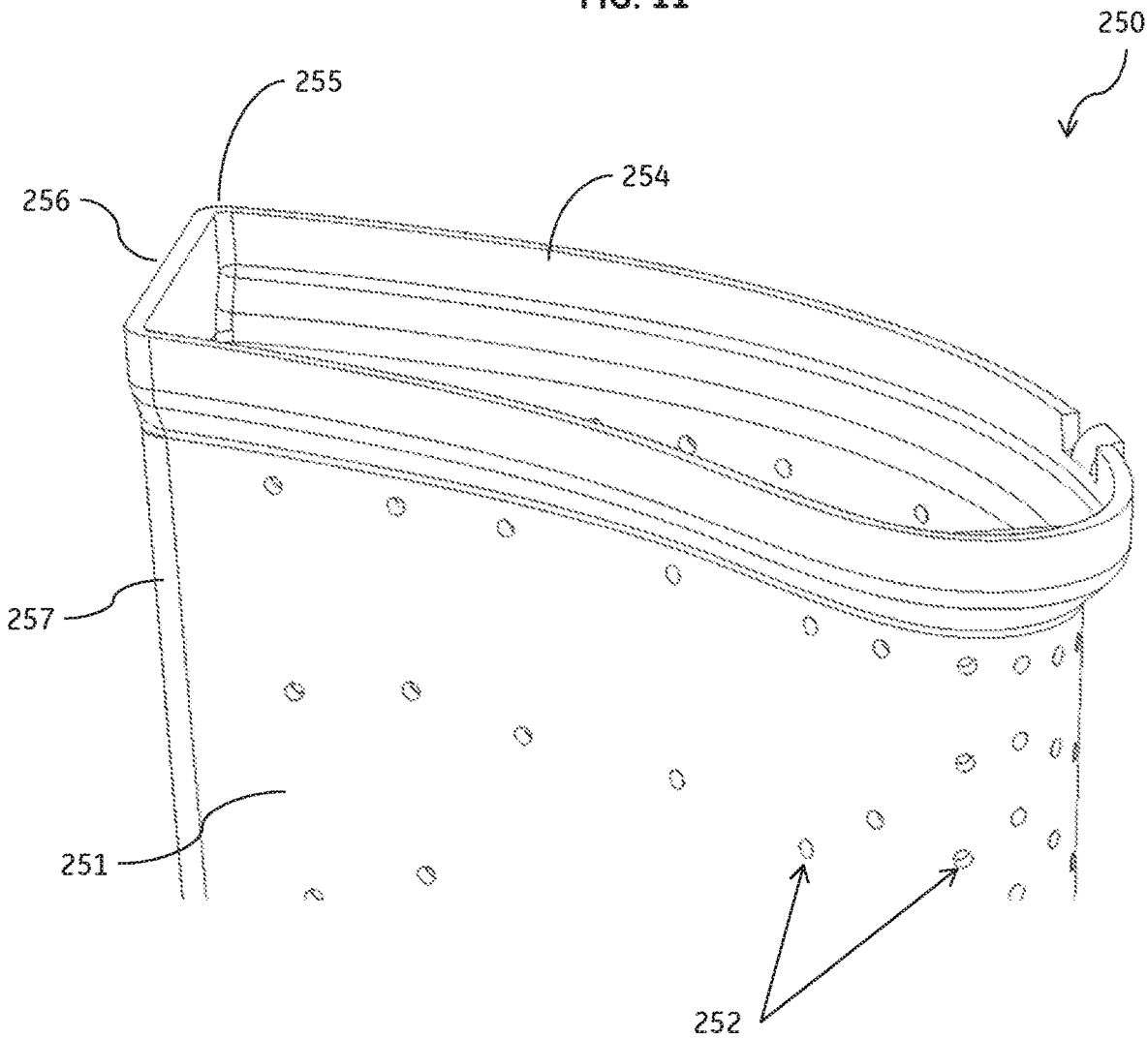
FIG. 11 is a perspective view of an exemplary forward cavity insert, according to the present disclosure.

FIGS. 10 and 11 illustrate, respectively, a modified aft cavity insert 240 and a modified forward cavity insert 250. The modified inserts 240, 250 may have a body 241, 251 having a shape that corresponds to, and is offset from, inner surfaces of the cavity 212, 214, the cavities 212, 214 themselves being defined by the nozzle 205 and the rib 216. The body 241, 251 of the inserts 240, 250 may define a number of perforations 242, 252 therethrough. In one embodiment, the perforations 242, 252 may be of different sizes, shapes, locations, or patterns from the cooling holes 95, 97 in the inserts 94, 96 that may have been originally installed in the aft and forward cavities 88, 90.

The modified inserts 240, 250 include a rib cap-interfacing surface 246, 256 that contacts the rib cap 230, when the inserts 240, 250 are installed. An outwardly projecting lip 244, 254, extends from one edge 245, 255 of the rib cap-interfacing surface 246, 256 to the opposite edge 247, 257 of the rib cap-interfacing surface 246, 256. The outwardly projecting lip 244, 254 extends outward from the body 241, 251 of the insert 240, 250 and, when installed, extends radially beyond the nozzle platform 224. Notably, the rib cap-interface surface 246, 256 of the insert 240, 250 is complementary to the rib cap 230, such that the surface 246, 256 abuts the rib cap 230 (as shown in FIG. 13). The rib cap-interface surfaces 246, 256 may or may not extend radially beyond the inlet surface of the rib cap 230.

As shown in FIGS. 12 and 13, a nozzle assembly 200 includes the nozzle 225 having the aft cavity 212 within which the aft cavity insert 240 is installed and the forward cavity 214 within which the forward cavity insert 250 is installed. The rib cap 230 may be positioned on the rib 216 in the rib cap recess 220 between the modified inserts 240, 250. The exemplary nozzle 205 herein includes aft and forward cavities 212, 214 with corresponding aft and forward cavity inserts 240, 250. However, nozzles having more than two internal cavities and more than one rib may be similarly outfitted with rib caps 230, as described herein. In such instances, the rib cap 230 may have any size, shape, or configuration appropriate for its location within a respective nozzle. A number of differently sized and shaped rib caps 230 thus may be used herein.

The use of the rib cap 230 thus modifies the size and shape of the cavities 212, 214. By installing the rib cap 230 onto the rib 216 and thus altering the perimeter of the cavities 212, 214, only the corresponding modified inserts 240, 250 may be positioned in the respective cavities 212, 214. The rib cap 230 largely "murphy-proofs" each nozzle 205 in that only the correct modified insert 240, 250 will fit therein. For instance, in the case where the modified inserts 240, 250 (e.g., inserts having a modified cooling hole pattern) are to be installed, the use of the rib cap 230 prevents the previously removed inserts 94, 96 from fitting into the truncated cavities 212, 214.

Moreover, the ability to provide and correctly install modified inserts 240, 250 without having to change the casting tool for the nozzle 205 offers a significant advantage in material and time savings. The modified inserts 240, 250 improve the performance of the nozzle 205, as compared to original inserts 94, 96, and the correct installation of the inserts 240, 250 is made possible by the use of the rib cap 230 to define the appropriate inlet perimeter of the cavities 212, 214.

It should be apparent that the foregoing relates only to certain embodiments of the present disclosure. Numerous changes and modifications may be made herein by one of ordinary skill in the art without departing from the general spirit and scope of the disclosure, as defined by the following claims and the equivalents thereof.

What is claimed is:

1. A nozzle assembly, comprising:

an airfoil extending in a radial direction;

a platform coupled to the airfoil and including a recess area in a radially outer surface thereof;

a first nozzle cavity extending through the airfoil and the platform;

a second nozzle cavity extending through the airfoil and the platform;

a rib extending from a first side of the airfoil to an opposing second side of the airfoil and separating the first nozzle cavity and the second nozzle cavity, the rib defining a radially outermost end proximate to the platform, wherein the recess area defines notches on opposing sides of the airfoil adjacent the rib;

a first cavity insert positioned in the first nozzle cavity, the first cavity insert having a first rib cap-interfacing surface;

a second cavity insert positioned in the second nozzle cavity, the second cavity insert having a second rib cap-interfacing surface;

a rib cap separate from the airfoil, the rib cap seated in the recess area in the platform and positioned between the first cavity insert and the second cavity insert and abutting both the first rib cap-interfacing surface and the second rib cap-interfacing surface after the first cavity insert and the second cavity insert are positioned in the first nozzle cavity and the second nozzle cavity, respectively.

2. The nozzle assembly of claim 1, wherein the recess area is co-planar with the radially outermost end of the rib.

3. The nozzle assembly of claim 1, wherein the recess area has a depth, and the rib cap has a height greater than the depth of the recess area.

4. The nozzle assembly of claim 1, wherein the first nozzle cavity comprises an aft nozzle cavity in which the first cavity insert is positioned, the first nozzle cavity insert having an outwardly projecting lip along an inlet edge thereof, the outwardly projecting lip extending from a first edge of the first rib cap-interfacing surface to a second edge of the first rib cap-interfacing surface.

5. The nozzle assembly of claim 1, wherein the second nozzle cavity comprises a forward nozzle cavity in which the second cavity insert is positioned, the second nozzle cavity insert having an outwardly projecting lip along an inlet edge thereof, the outwardly projecting lip extending from a first edge of the second rib cap-interfacing surface to a second edge of the second rib cap-interfacing surface.

6. The nozzle assembly of claim 1, wherein the first cavity insert comprises a body having a plurality of cooling holes.

7. The nozzle assembly of claim 1, wherein the second cavity insert comprises a body having a plurality of cooling holes.

8. The nozzle assembly of claim 1, wherein the rib cap is one of brazed to the rib and welded to the rib.

9. The nozzle assembly of claim 1, wherein the rib includes at least one air flow aperture providing fluid communication between the first nozzle cavity and the second nozzle cavity.

10. The nozzle assembly of claim 1, wherein the radially outermost end of the rib separating the first nozzle cavity and the second nozzle cavity includes a radially outermost surface, and the rib cap is radially aligned with the recess area across the radially outermost surface of the rib.

11. The nozzle assembly of claim 1, wherein the recess area has a first length, and the rib cap has a second length that conforms with the first length of the recess area.

12. The nozzle assembly of claim 1, wherein the radially outermost end of the rib separating the first nozzle cavity and the second nozzle cavity includes a radially outermost surface having a first width, and the rib cap has a second width that is greater than the first width of the radially outermost surface of the rib, such that the rib cap extends outward of the rib into portions of the first nozzle cavity and the second nozzle cavity immediately adjacent the rib.

13. The nozzle assembly of claim 1, wherein the rib separating the first nozzle cavity and the second nozzle cavity includes a radially outermost surface, and the rib cap has a shape that conforms with a shape of the radially outermost surface.

14. The nozzle assembly of claim 1, wherein the rib cap has a rectangular shape.

* * * * *